US008404061B2

(12) United States Patent
Braun et al.

(10) Patent No.: US 8,404,061 B2
(45) Date of Patent: Mar. 26, 2013

(54) METHOD FOR PRODUCING A COMPONENT FROM AN AIR-HARDENABLE STEEL AND COMPONENT PRODUCED THEREWITH

(75) Inventors: Michael Braun, Lehre (DE); Uwe Eggers, Wolfenbüttel (DE); Cord Schäffner, Hannover (DE); Joachim Schöttler, Braunschweig (DE); Friedrich Luther, Braunschweig (DE); Stefan Mütze, Hannover (DE); Manuel Otto, Magdeburg (DE); Thorsten Reier, Lahstedt (DE)

(73) Assignee: Salzgitter Flachstahl GmbH, Salzgitter (DE)

( * ) Notice: Subject to any disclaimer, the term of this patent is extended or adjusted under 35 U.S.C. 154(b) by 0 days.

(21) Appl. No.: 13/381,128

(22) PCT Filed: Jun. 21, 2010

(86) PCT No.: PCT/DE2010/000721

§ 371 (c)(1),
(2), (4) Date: Dec. 28, 2011

(87) PCT Pub. No.: WO2011/000351

PCT Pub. Date: Jan. 6, 2011

(65) Prior Publication Data

US 2012/0107632 A1 May 3, 2012

(30) Foreign Application Priority Data

Jun. 29, 2009 (DE) ..... 10 2009 031 570
Jun. 18, 2010 (DE) ..... 10 2010 024 664

(51) Int. Cl.
*C22C 38/22* (2006.01)

(52) U.S. Cl. ..... 148/654; 148/593

(58) Field of Classification Search ..... 148/654, 148/593

See application file for complete search history.

(56) References Cited

U.S. PATENT DOCUMENTS
(Continued)

FOREIGN PATENT DOCUMENTS

DE 44 46 709 A1 6/1996
DE 102 21 487 9/2003

(Continued)

OTHER PUBLICATIONS

NPL-1: Lee, English abstract of KR2001073577, Aug. 2001.*

(Continued)

*Primary Examiner* — Jie Yang
(74) *Attorney, Agent, or Firm* — Henry M. Feiereisen LLC

(57) ABSTRACT

A component of an air-hardenable steel composed of (contents in mass %): C<0.20; Al<0.08; Si<1.00; Mn 1.20 to <2.50; P<0.020; S<0.015; N<0.0150; Cr 0.30 to <1.5; Mo 0.10 to <0.80; Ti 0.010 to <0.050; V 0.03 to <0.20; B 0.0015 to <0.0060, with the remainder being iron including the usual elements present in steel, is produced by heating a hot- or cold-rolled steel sheet or steel tube section to a temperature of $\theta_{blank}$=800 to 1050° C. and then forming the sheet or tube into a component in a forming tool. After removal from the tool, the component is cooled down in air while the component still has a temperature above $\theta_{removal}$=200° C. and below 800° C. The component achieves the required mechanical properties during air-cooling.

7 Claims, 2 Drawing Sheets

U.S. PATENT DOCUMENTS

| | | | | |
|---|---|---|---|---|
| 3,668,917 | A | 6/1972 | Komatsu et al. | |
| 5,370,751 | A | 12/1994 | von Hagen et al. | |
| 6,564,604 | B2 | 5/2003 | Kefferstein et al. | |
| 7,559,998 | B2 * | 7/2009 | Nishibata et al. | 148/330 |
| 2001/0042393 | A1 | 11/2001 | Kefferstein et al. | |
| 2007/0012748 | A1 * | 1/2007 | McCrink et al. | 228/101 |
| 2007/0235113 | A1 | 10/2007 | Knaup | |
| 2009/0173412 | A1 | 7/2009 | Schöttler et al. | |

FOREIGN PATENT DOCUMENTS

| | | | |
|---|---|---|---|
| DE | 10 2004 053 620 | | 5/2006 |
| DE | 601 19 826 | T2 | 12/2006 |
| DE | 10 2006 026 805 | | 1/2008 |
| EP | 0 576 107 | B1 | 6/1995 |
| EP | 1 642 991 | A1 | 4/2006 |

OTHER PUBLICATIONS

Maikranz-Valentin M et al.: "Components with optimized properties due to advanced thermo-mechanical process strategies in hot sheet metal forming", Steel Research International, Verlag Stahleisen GmbH, Düsseldorf, DE, vol. 79, No. 2, Feb. 1, 2008, pp. 92-97, ISSN: 1611-3683, figures 9-11.

* cited by examiner

| Steel Grade LH800® | C | Mn | Si | P | S | Al | Cr | B | Mo | Sum Micro-Alloys[1)] |
|---|---|---|---|---|---|---|---|---|---|---|
| Min. | 0.07 | 1.60 | 0.15 | – | – | 0.020 | 0.50 | 0.0015 | 0.10 | 0.08 |
| Max. | 0.15 | 2.10 | 0.30 | 0.015 | 0.010 | 0.050 | 1.00 | 0.0040 | 0.30 | 0.15 |

[1)] Micro-Alloys: Ti, V, Nb

FIG. 2

METHOD FOR PRODUCING A COMPONENT FROM AN AIR-HARDENABLE STEEL AND COMPONENT PRODUCED THEREWITH

CROSS-REFERENCES TO RELATED APPLICATIONS

This application is the U.S. National Stage of International Application No. PCT/DE2010/000721, filed Jun. 21, 2010, which designated the United States and has been published as International Publication No. WO 2011/000351 and which claims the priority of German Patent Applications, Serial No. 10 2009 031 570.5, filed Jun. 29, 2009, and Serial No. 10 2010 024 664.6, filed Jun. 18, 2010, pursuant to 35 U.S.C. 119(a)-(d).

BACKGROUND OF THE INVENTION

The invention relates to a method for producing a component from an air-hardenable steel having excellent forming properties, in particular for lightweight vehicles. The invention also relates to a component produced with the method according to the invention.

The term component is to be understood in the following as a component formed from a sheet-metal blank or tube by forming with a forming tool.

The hotly contested automotive marketplace requires the manufacturers to continuously search for solutions for lowering the fleet fuel consumption while simultaneously maintaining the highest possible comfort and protection for the occupants. On one hand, the weight savings of all vehicle components plays an important role; on the other hand, highly advantageous properties of the individual component under high static and dynamic stress during the operation and in the event of a crash are also important.

The suppliers attempt to address these demands by reducing the wall thicknesses by providing high-strength and ultra-high-strength steels while simultaneously improving the properties of the components during manufacture and in operation. Such steels must satisfy comparatively high demands relating to strength, elasticity, tenacity, energy absorption and machinability by, for example, cold-forming, welding and/or corrosion resistance.

For ensuring corrosion resistance, metallic coatings made of zinc, aluminum or corresponding alloys based on zinc or aluminum which may contain additional alloying elements, such as Mg or Si, may be considered.

In addition to the aforedescribed general requirements, ultra-high-strength steels should attain the following exemplary mechanical characteristic values:

$R_{el}$bzw. $R_{p0,2}$: 700-1000 [MPa]
$R_m$: 800-1200 [MPa]
$A_{80}$: ≧10[%] and/or
$A_5$: ≧13[%].

In the past, for applications of the crash- or weight-optimized components, mostly conventional steels with a relatively large sheet-metal thickness, water-quenched high-strength small-grain steels, multiphase steels or alternative materials, such as aluminum, were used.

Disadvantageously, conventional steels have a high component weight. Disadvantages of alternative ultra-high-strength multiphase steels are their poor weldability and forming properties due to the high basic hardness. Water-quenched and hardened steels are expensive to manufacture and therefore uneconomical.

Air-hardenable steel materials have been developed as an alternative, which overcome the disadvantages of conventional steels by realizing the required material properties solely by cooling the steel in air, for example following a heat treatment of the component. After cold-forming or shaping, the air hardening state can be adjusted by way of a subsequent heat treatment.

DE 102 21 487 B4, EP 0 576 107 B1 and DE 44 46 709 A1 disclose air-hardenable steels which can in principle be used for vehicle components. DE 10 2004 053 620 A1 discloses an advanced air-hardenable steel with excellent forming and welding properties with the following composition (concentration in mass-%):

C 0.07 to ≦0.15
Al≦0.05
Si 0.15 to ≦0.30
Mn 1.60 to ≦2.10
P≦0.020
S≦0.010
N≦0.0150
Cr 0.50 to ≦1.0
Mo 0.30 to ≦0.60
Ti 0.010 to ≦0.050
V 0.12 to ≦0.20
B 0.0015 to ≦0.0040
remainder iron, including typical elements in steel production.

The manufacture of components produced by quenching of press-hardenable steels in a forming tool is known from DE 601 19 826 T2. A sheet-metal blank which was previously heated to a temperature of $\theta_{blank}$=800 to 1200° C. and provided with a metallic coating of zinc or based on zinc is formed into a component in an optionally cooled forming tool, wherein for attaining the required strength the metal sheet or the component is subjected during the forming process in the forming tool to quench-hardening (press-hardening) through rapid heat removal.

It has been observed in experiments that for attaining a desired tensile strength, the component must be subjected to subsequent annealing. This is complex and expensive and in addition reduces again the strength of the hardened component.

It has also been recognized in these experiments that components made of air-hardenable steels cannot be produced with the process disclosed in DE 601 19 826 T2, because the required elongation in the formed component can also not be attained with the quenching process.

It was therefore the object of the invention to provide a method for producing components made of air-hardenable steels with a forming tool, wherein the required mechanical properties on the formed component can be safely maintained while eliminating a final annealing step.

SUMMARY OF THE INVENTION

According to the teaching of the invention, this object is attained with a method, wherein a component is produced from an air-hardenable steel comprising the elements (composition in mass-%):

C≦0.20
Al≦0.08
Si≦1.00
Mn 1.20 to ≦2.50
P≦0.020
S≦0.015
N≦0.0150
Cr 0.30 to ≦1.5
Mo 0.10 to ≦0.80
Ti 0.010 to ≦0.050

V 0.03 to ≦0.20

B 0.0015 to ≦0.0060 remainder iron, including typical elements associated with steel production, wherein a hard-rolled or cold-rolled steel sheet blank or steel tube blank is heated to a temperature of $\theta_{blank}$=800 to 1050° C. and subsequently formed into a component in a forming tool and cooled down in air after removal from the tool, wherein after removal from the forming tool the component still has a temperature above $\theta_{Removal}$=200° C. and below 800° C. and attains the required mechanical properties after cool-down in air.

It is not necessarily to add Al and Si to the steel, but these elements may be included as elements associated with steel production. C is always present in steel; however, the C-content should be limited to ≦0.20% in consideration of the weldability.

The method according to the invention has the advantage compared to the method for producing a component disclosed in DE 601 19 826 T2 that a subsequent expensive annealing step for attaining the required value for the tensile strength in the component can be eliminated by using an air-hardenable steel accompanied by a slow cooldown in the forming tool and subsequent air-cooling.

In addition, the shapes may be more easily changed due to improved forming properties of heated blanks, because the blanks can be additionally formed by taking advantage of the residual heat, thus allowing more complex geometries compared with conventional methods.

The residual heat of the component after removal is also beneficial for the subsequent cutting operation, because the cutting forces decrease with increasing workpiece temperatures. In addition, hot-forming of the workpiece requires significantly lower pressing forces than cold-forming.

To prevent premature hardening in the forming tool, it may be necessary to provide the forming tool with a heater for realizing the desired slow cooling in the forming tool by taking into account the duration of the forming process. For maintaining the desired minimum elongation of $A_5$≧13% and tensile strengths of $R_m$=800-1200 MPa, average cooling speeds of dT/dt<150 K/s in a forming process having a duration of t<5 s in the forming tool have proven to be advantageous.

With the method of the invention, existing hot-forming installations at the vehicle manufacturers and suppliers can advantageously be used, thereby reducing the manufacturing costs compared to conventional methods for processing air-hardenable materials. The shorter tool assignment times during hot-forming in comparison to conventional boron-manganese steels are also advantageous.

DETAILED DESCRIPTION OF PREFERRED EMBODIMENTS

Figures 1A, 1B:
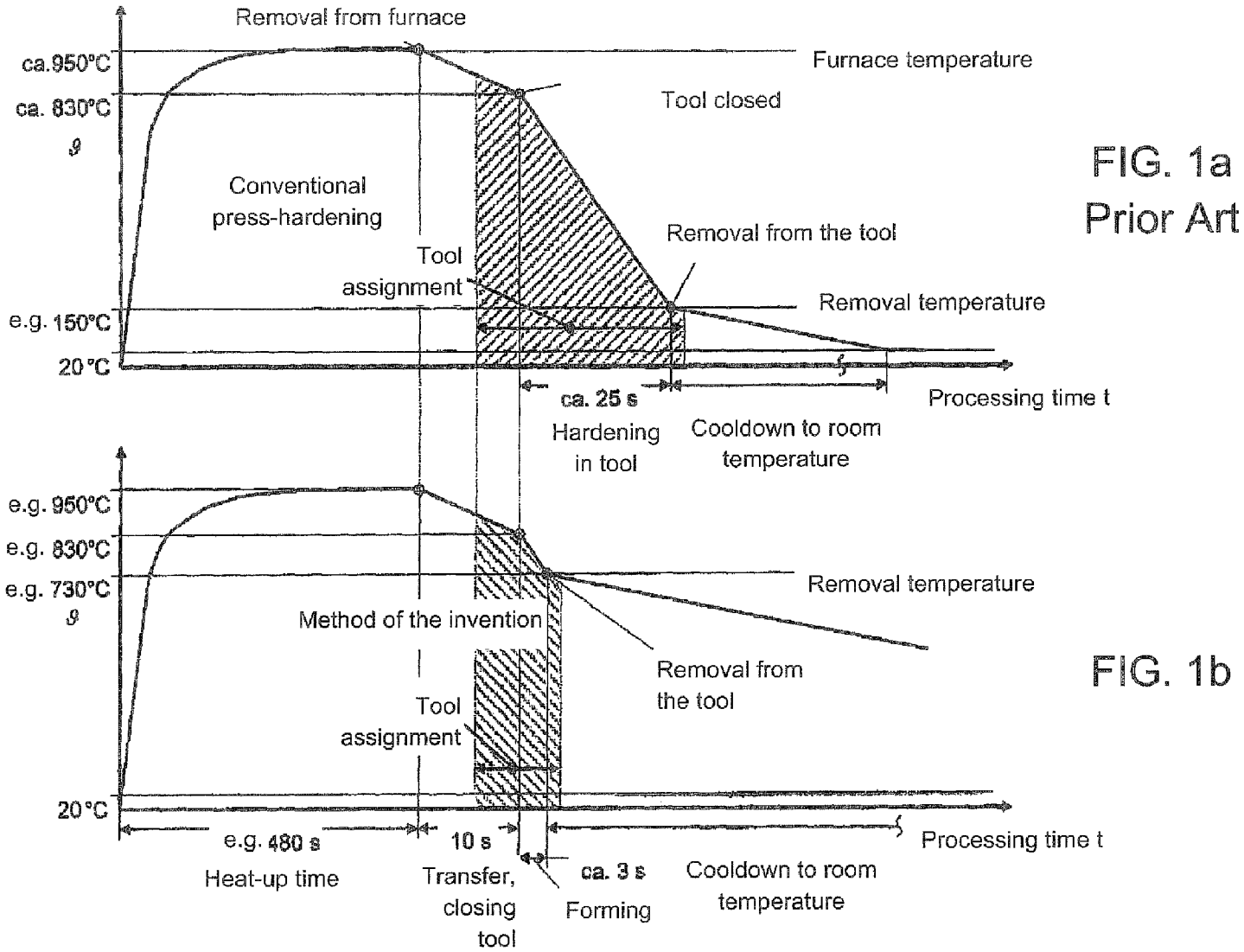
FIG. 1a Prior Art
FIG. 1*a* shows a schematic process flow of a conventional press-hardening process.
FIG. 1*b* shows a schematic process flow during hot-forming of air-hardenable steels having the disclosed alloy composition according to the invention, and FIG. 2 lists a typical composition of an advanced conventional air-hardenable steel.

FIG. 1*a* shows a schematic process flow of a conventional press-hardening process. FIG. 1*b* shows a schematic process flow during hot-forming of air-hardenable steels having the indicated alloy composition according to the invention. The temperature curves for conventional forming of press-hardenable steels having the composition listed in FIG. 2 (FIG. 1*a*) and for the method of the invention for air-hardenable steels (FIG. 1*b*) indicate the essential differences. As clearly seen, a process cycle with air-hardenable steels has a shorter association time of the forming press, which has a positive economic impact on the entire process.

In the present example, the component made of the air-hardenable material is heated according to the method of the invention to about 950° C., subsequently inserted in the forming tool and removed from the tool immediately after forming at about 730° C. and cooled down in air.

The components produced with the invention have also a high dimensional stability, wherein the material composition for the air-hardenable steel is selected to ensure excellent weldability during further processing in the formed as well as in the air-hardened state.

Compared to conventional manufacturing processes, the improved mechanical properties (high elongation with simultaneously high-strength) allow a significantly enhanced product spectrum. For example, this method can now also be used to produce cost-effectively vehicle components from air-hardenable steel.

According to the invention, the tape blank or tube blank used for hot-forming can already be provided with a metallic coating made of, for example, zinc or aluminum or from suitable alloys based on zinc or aluminum. An alloy coating made of an aluminum alloy may contain, for example, silicon in concentrations from 8 to 12%.

The metallic coating of the hot tape or cold tape and/or of the tube produced therefrom is typically applied in a continuous melt-dip process (hot-dip galvanizing, hot-dip aluminizing), wherein the tape or tube is subsequently cut to size for the forming tool. Alternatively, the workpiece (blank) to be formed may also be provided with a hot-dip coating.

Applying a metallic coating before hot-forming is quite advantageous because the coating effectively prevents scaling of the base material and the lubrication effect reduces tool wear.

The advantages of the method according to the invention will now be listed again:

- no subsequent heat treatment is required,
- higher strengths compared to conventional processing methods,
- greater ability to change shapes compared to shaping by cold-forming or direct press-hardening of boron-manganese steels,
- smaller forming forces compared to shaping by cold-forming,
- existing facilities remain usable for hot-forming (press-hardening),
- shorter tool association time compared to press-hardening,
- high dimensional stability,
- excellent weldability,
- good coating properties using conventional coating methods, such as cathodic dip-paint coating (KTL), hot-dip galvanizing, hot-dip aluminizing and high-temperature galvanizing,
- applicability for welded components subjected to high static and dynamic loads.

The invention claimed is:

1. A method for producing components from an air-hardenable steel comprising the following elements (composition in mass-%):

C≦0.20

Al≦0.08

Si≦1.00

Mn 1.20 to ≦2.50
P≦0.020
S≦0.015
N≦0.0150
Cr 0.30 to ≦1.5
Mo 0.10 to ≦0.80
Ti 0.010 to ≦0.050
V 0.03 to ≦0.20
B 0.0015 to ≦0.0060
remainder iron, including typical elements in steel production, the method comprising the steps of:

heating a hot-rolled or cold-rolled steel sheet blank or steel tube blank to a temperature of $\theta_{blank}$=800 to 1050° C., transferring the hot steel blank to a forming tool, closing the forming tool, forming the hot-rolled or cold-rolled steel sheet blank or steel tube blank into a component in the closed forming tool for a duration of less than 5 sec, while simultaneously heating the forming tool to attain a cooling rate of the blank of at most 150 K/s, removing the formed component from the forming tool while the component has a temperature between 200° C. and 800° C., and cooling the formed component down in air after removal from the forming tool at a cooling rate less than the cooling rate in the forming tool, thereby hardening the component during cooldown in air to attain a minimum elongation of no less that 13% and a tensile strength between 800 MPa and 1200 MPa.

2. The method of claim 1, wherein the component is transported for additional processing immediately after removal from the forming tool by taking advantage of residual heat.

3. The method of claim 1, and further performing forming or cutting operations on the component.

4. The method of claim 1, and further applying a metallic coating to the hot-rolled or cold-rolled steel sheet blank or steel tube blank before forming.

5. The method of claim 1, and further applying a metallic coating to a steel tape or steel tube used for the blank in a continuous process.

6. The method of claim 4, wherein the metallic coating is made of at least one of zinc and aluminum or of an alloy based on at least one of zinc and aluminum.

7. The method of claim 5, wherein the metallic coating is made of at least one of zinc and aluminum or of an alloy based on at least one of zinc and aluminum.

* * * * *